US006015012A

United States Patent [19]

Reddick

[11] Patent Number: 6,015,012

[45] Date of Patent: Jan. 18, 2000

[54] IN-SITU POLYMERIZATION METHOD AND APPARATUS TO SEAL A JUNCTION BETWEEN A LATERAL AND A MAIN WELLBORE

[75] Inventor: Mark S. Reddick, Houston, Tex.

[73] Assignee: Camco International Inc., Houston, Tex.

[21] Appl. No.: 08/920,994

[22] Filed: Aug. 29, 1997

Related U.S. Application Data

[60] Provisional application No. 60/024,960, Aug. 30, 1996.

[51] Int. Cl.[7] ..... E21B 7/06

[52] U.S. Cl. ..... 166/313; 166/50; 166/117.5

[58] Field of Search ..... 166/297, 298, 166/50, 387, 378, 313, 117.5

[56] References Cited

U.S. PATENT DOCUMENTS

| | | | |
|---|---|---|---|
| 5,353,876 | 10/1994 | Curington et al. | 166/313 |
| 5,427,177 | 6/1995 | Jordan, Jr. et al. . | |
| 5,462,120 | 10/1995 | Gondouin . | |
| 5,474,131 | 12/1995 | Jordan, Jr. et al. . | |
| 5,477,925 | 12/1995 | Trahan et al. . | |
| 5,531,270 | 7/1996 | Fletcher et al. . | |
| 5,564,503 | 10/1996 | Longbottom et al. . | |
| 5,566,763 | 10/1996 | Williamson et al. . | |
| 5,613,559 | 3/1997 | Williamson et al. . | |
| 5,615,740 | 4/1997 | Comeau et al. . | |
| 5,787,987 | 8/1998 | Forsyth et al. | 166/313 |

FOREIGN PATENT DOCUMENTS

WO 94/03699 2/1994 WIPO .

*Primary Examiner*—William Neuder
*Assistant Examiner*—Zakiya Walker
*Attorney, Agent, or Firm*—Tobor, Goldstein & Healey, L.L.P.

[57] ABSTRACT

An improved method and apparatus for sealing a junction between a central and lateral wellbore is provided. In a broad aspect, the method of the present invention includes installing a polymerizable sealing sleeve within a first casing in a central wellbore at a junction between the first casing and a second casing in a lateral wellbore. After the sealing sleeve has been installed and allowed to cure, a milling tool is used to mill a window through a sidewall of the sealing sleeve and flush with the inner diameter of the second casing. The sealing sleeve may be used alone to establish a primary seal, or in combination with cement or other sealing substance, as used heretofore in prior art sealing methods, as a back-up seal. The sealing sleeve of the present invention may be provided with at least one orienting means to enable the second casing to be located and to direct a well tool thereinto.

26 Claims, 4 Drawing Sheets

IN-SITU POLYMERIZATION METHOD AND APPARATUS TO SEAL A JUNCTION BETWEEN A LATERAL AND A MAIN WELLBORE

RELATED APPLICATIONS

This application claims the benefit of U.S. Provisional Application Ser. No. 60/024,960, filed Aug. 30, 1996.

BACKGROUND OF THE INVENTION

1. Field of the Invention

The present invention relates to subsurface well completion equipment and, more particularly, to a method and apparatus for sealing the junction between a main wellbore and at least one lateral wellbore drilled from the main wellbore.

2. Description of the Related Art

In recent years, those engaged in the exploration of oil and gas have determined that production from a central wellbore can be economically enhanced by drilling one or more lateral branch wellbores out from the central wellbore. To drill a lateral wellbore, an opening or window must first be cut through a casing in the central wellbore at a location where it is desired to start drilling the lateral wellbore. This can be done before or after the casing is lowered into the main wellbore. A mechanical diverter, commonly referred to as a whipstock, is then placed inside the main wellbore just below the casing window. If the casing window is to be cut after the casing is already cemented in place in the central wellbore, then a milling tool is guided by the whipstock to mill the casing window in the casing. A drilling tool is then lowered into the main wellbore and diverted into and through the casing window by the whipstock. The drilling tool then continues on to drill the lateral wellbore. When the lateral wellbore has been drilled, the drilling tool is removed, and a casing string is lowered into the main wellbore, through the casing window, and into the lateral wellbore. It is very important that a seal be established at the junction of the main wellbore casing and the lateral wellbore casing; the present invention is directed to this need.

One approach used heretofore to seal the junction has been to simply pump cement down the main wellbore casing, into the lateral wellbore casing, down to the end of the lateral wellbore casing, back up into the annulus between the lateral wellbore and the lateral wellbore casing, and to the annulus adjacent the junction between the main wellbore casing and the lateral wellbore casing. Others have attempted to seal the junction in a similar manner, but with substances other than cement. The apparatus and method of the present invention, as more fully described below, were developed to provide an improved approach to sealing the junction between a main and lateral wellbores. A further object of the apparatus and method of the present invention is to include a means of locating the junction between the main and lateral wellbores to enable reentry into the lateral wellbore.

SUMMARY OF THE INVENTION

In accordance with the present invention, the foregoing objectives have been achieved by the present method and apparatus. In a broad aspect, the present invention may be a method of sealing a junction between a central wellbore having a first casing and at least one lateral branch wellbore comprising the steps of: running and setting a lower whipstock in the first casing; running and setting a window mill pilot in the first casing; milling a window in the first casing; drilling a lateral branch wellbore through the casing window out from the central wellbore; removing the window mill pilot from the first casing; running and setting an upper whipstock in the first casing adjacent and above the lower whipstock; running a second casing into the first casing, through the casing window, and into the lateral branch wellbore such that a stub portion of the second casing extends from the lateral branch wellbore through the casing window and into the first casing; milling the stub portion of the second casing flush with an inner diameter of the first casing; retrieving the upper whipstock from the first casing; running and installing an in-situ polymerizable sleeve in the first casing adjacent the junction of the first and second casings; running and setting a window remill pilot inside the in-situ polymerizable sleeve adjacent the junction of the first and second casings; milling a window in the in-situ polymerizable sleeve; retrieving the window remill pilot from inside the in-situ polymerizable sleeve; and removing the lower whipstock from the first casing. Another feature of this aspect of the present invention is that an upper surface of the upper whipstock may be aligned with a lower edge of the casing window when the upper whipstock is set in place. Another feature of this aspect of the present invention is that the method may further include the step of cleaning the first casing after the step of milling the stub portion flush with the inner diameter of the first casing. Another feature of this aspect of the present invention is that the window in the in-situ polymerizable sleeve may be milled flush with an inner diameter of the second casing. Another feature of this aspect of the present invention is that the lower whipstock may be removed by retrieving it through the in-situ polymerizable sleeve. Another feature of this aspect of the present invention is that the lower whipstock may be removed by drilling it out. Another feature of this aspect of the present invention is that the method may further include the step of using a sealing substance to set the second casing in place within the lateral branch wellbore after it has been positioned and before its stub portion is milled flush with the inner diameter of the first casing, whereby the polymerizable sleeve operates as a back-up seal to the sealing substance. Another feature of this aspect of the present invention is that the sealing substance may be cement. Another feature of this aspect of the present invention is that the sleeve may further include at least one orienting device for locating the second casing when access is desired thereto, and for selectively directing a well tool into the second casing. Another feature of this aspect of the present invention is that the sleeve may further include a first and a second orienting device, the first orienting device being attached to a first end of the sleeve, and the second orienting device being attached to a second end of the sleeve, the orienting devices being used to locate the second casing when access is desired thereto, and to selectively direct a well tool into the second casing. Another feature of this aspect of the present invention is that the sleeve may further include: a cylindrical body having a longitudinal bore therethrough constructed of fibers and polymerizable resins; a drillable sidewall in the cylindrical body; and a resilient outer skin substantially covering the cylindrical body.

In another aspect, the present invention may be a method of sealing a junction between a central wellbore having a first casing and at least one lateral branch wellbore comprising the steps of: running and setting a whipstock in the first casing; diverting a milling tool off the whipstock to mill a window in the first casing; drilling a lateral branch wellbore through the casing window out from the central wellbore; running a second casing into the first casing, and diverting the second casing off the whipstock through the casing window and into the lateral branch wellbore such that a stub portion of the second casing extends from the lateral branch wellbore through the casing window and into the first casing; milling the stub portion of the second casing flush with an inner diameter of the first casing; running and installing an in-situ polymerizable sleeve in the first casing adjacent the junction of the first and second casings; milling a window in the in-situ polymerizable sleeve adjacent the casing window; and, removing the whipstock from the first casing. Another feature of this aspect of the present invention is that the method may further include the step of cleaning the first casing after the step of milling the stub portion flush with the inner diameter of the first casing. Another feature of this aspect of the present invention is that the in-situ polymerizable sleeve is milled flush with an inner diameter of the second casing. Another feature of this aspect of the present invention is that the whipstock may be removed by retrieving it through the in-situ polymerizable sleeve. Another feature of this aspect of the present invention is that the whipstock may be removed by drilling it out. Another feature of this aspect of the present invention is that the method may further include the step of using a sealing substance to set the second casing in place within the lateral branch wellbore after it has been positioned and before its stub portion is milled flush with the inner diameter of the first casing, whereby the polymerizable sleeve operates as a back-up seal to the sealing substance. Another feature of this aspect of the present invention is that the sealing substance may be cement. Another feature of this aspect of the present invention is that the sleeve may further include at least one orienting device for locating the second casing when access is desired thereto, and for selectively directing a well tool into the second casing. Another feature of this aspect of the present invention is that the sleeve may further include a first and a second orienting device, the first orienting device being attached to a first end of the sleeve, the second orienting device being attached to a second end of the sleeve, and the orienting devices being used to locate the second casing when access is desired thereto and to selectively direct a well tool into the second casing. Another feature of this aspect of the present invention is that the sleeve may further include: a cylindrical body having a longitudinal bore therethrough constructed of fibers and polymerizable resins; a drillable sidewall in the cylindrical body; and a resilient outer skin substantially covering the cylindrical body.

In another aspect, the present invention may be, in a central wellbore having at least one lateral branch wellbore extending therefrom, the central wellbore having a first casing disposed therein, the first casing having a casing window disposed therein, the lateral branch wellbore having a second casing disposed therein and adjacent the casing window to form a junction between the first and second casings, an improved method of sealing the junction, wherein the improvement comprises the steps of: installing an in-situ polymerizable sleeve in the first casing adjacent the junction so as to cover the casing window and seal the junction; and, milling a window in the in-situ polymerizable sleeve. Another feature of this aspect of the present invention is that the method may further include the steps of: running and setting a window remill pilot inside the in-situ polymerizable sleeve adjacent the junction after the sleeve is installed and before the sleeve window is milled; and retrieving the window remill pilot from inside the in-situ polymerizable sleeve after the sleeve window is milled. Another feature of this aspect of the present invention is that the window in the in-situ polymerizable sleeve may be milled flush with an inner diameter of the second casing. Another feature of this aspect of the present invention is that the sleeve may further include at least one orienting device for locating the second casing when access is desired thereto, and for selectively directing a well tool into the second casing. Another feature of this aspect of the present invention is that the sleeve may further include a first and a second orienting device, the first orienting device being attached to a first end of the sleeve, and the second orienting device being attached to a second end of the sleeve, the orienting devices being used to locate the second casing when access is desired thereto, and to selectively direct a well tool into the second casing. Another feature of this aspect of the present invention is that the junction has been previously sealed by a sealing substance and the in-situ polymerizable sleeve functions as a backup seal to the previous seal.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

Figure 2:
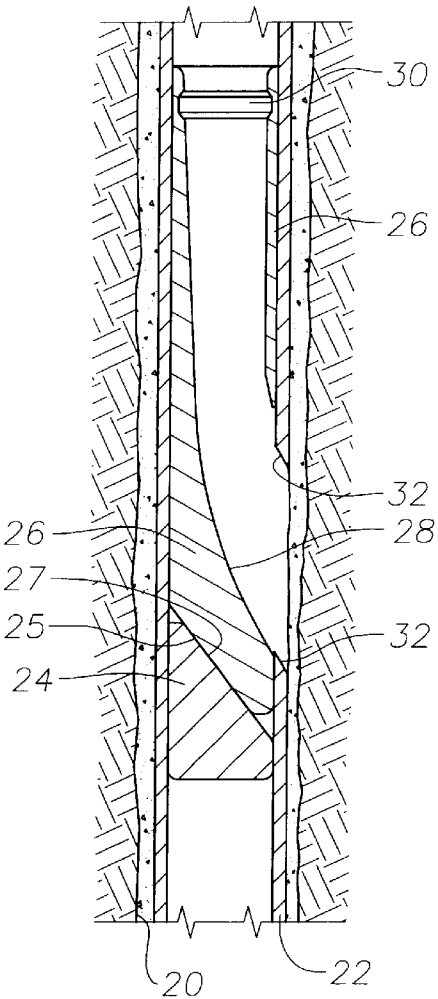
FIG. 2 is an elevation view showing a lower whipstock and a window mill pilot positioned within the casing, and a window that has been milled into a section of the casing.
Figure 1:
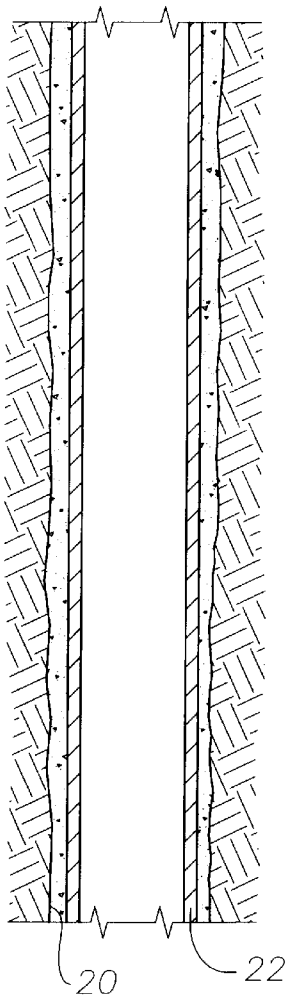
FIG. 1 is an elevation view of a cased central wellbore.

Referring to the drawings in detail, wherein like numerals denote identical elements throughout the several views, the method and apparatus of the present invention will now be explained, beginning with FIG. 1, which depicts a central wellbore 20 with a first casing 22 cemented in place therein. In a broad aspect, the first step of the method of the present invention is to create an opening in the first casing 22, if the first casing 22 is not already provided with such an opening. The opening should be located where it is desired to start drilling a lateral wellbore. In a specific embodiment of the method of the present invention, as shown in FIG. 2, an opening may be created by first running and setting a lower whipstock 24 having an upper inclined surface 25 in the first casing 22 below the location where it is desired to start drilling a lateral wellbore generally adjacent to a hydrocarbon producing formation (not shown). The whipstock 24 should be oriented (by the use, for example, of CCL technology, as known in the art) at the x,y,z coordinates needed to direct the lateral wellbore to the target production zone (not shown). The structure and operation of whipstocks, such as the lower whipstock 24, and the manner in which whipstocks are run, oriented, and set within a wellbore casing, are well known to those of ordinary skill in the art.

After the lower whipstock 24 has been set, the next step, as shown in FIG. 2, is to run and set a window mill pilot 26 having a lower inclined surface 27 in the central wellbore 20. The window mill pilot 26 is located above and adjacent the lower whipstock 24. The lower inclined surface 27 of the window mill pilot 26 mates with the upper inclined surface 25 of the lower whipstock 24, so as to position the window mill pilot 26 in its proper x,y,z orientation. The window mill pilot 26 is provided with an upper contoured surface 28, and an inner profile 30 for mating with a retrieving tool (not shown). The structure and operation of window mill pilots, such as the window mill pilot 26, and the manner in which they are run, oriented, and set within a wellbore casing, are well known to those of ordinary skill in the art. After the window mill pilot 26 has been set, the next step, as shown in FIG. 2, is to use a milling tool (not shown) to mill a window 32 in the first casing 22. The structure and operation of milling tools, and the manner in which they are used to mill windows in casing, are well known to those of ordinary skill in the art. Alternatively, the step of running and setting the window mill pilot 26 may be omitted, and the milling tool (not shown) may be diverted by the lower whipstock 24 to mill the window 32 in the first casing 22.

Figure 3:
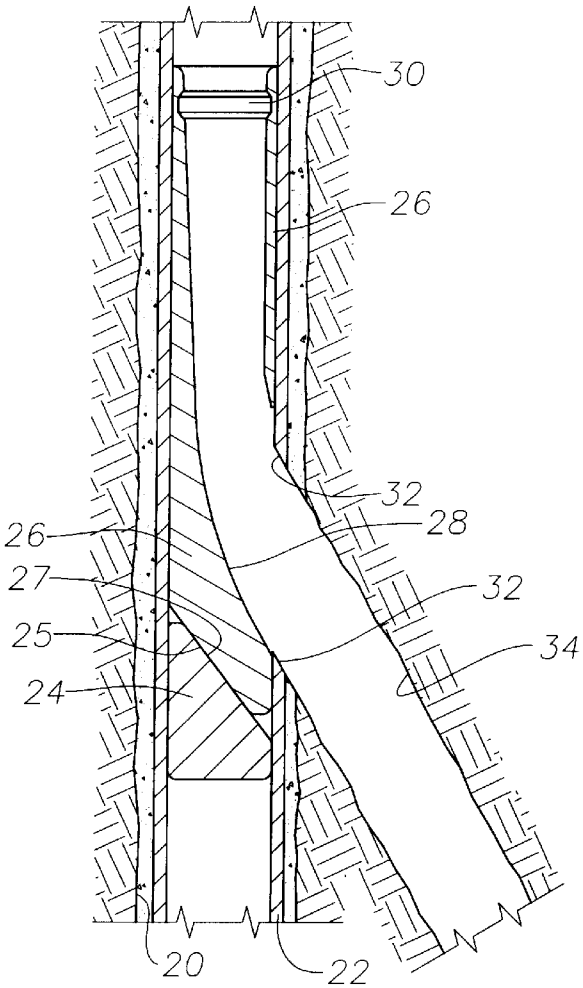
FIG. 3 is an elevation view showing a lateral wellbore that has been drilled adjacent the casing window shown in FIG. 2.
Figure 4:
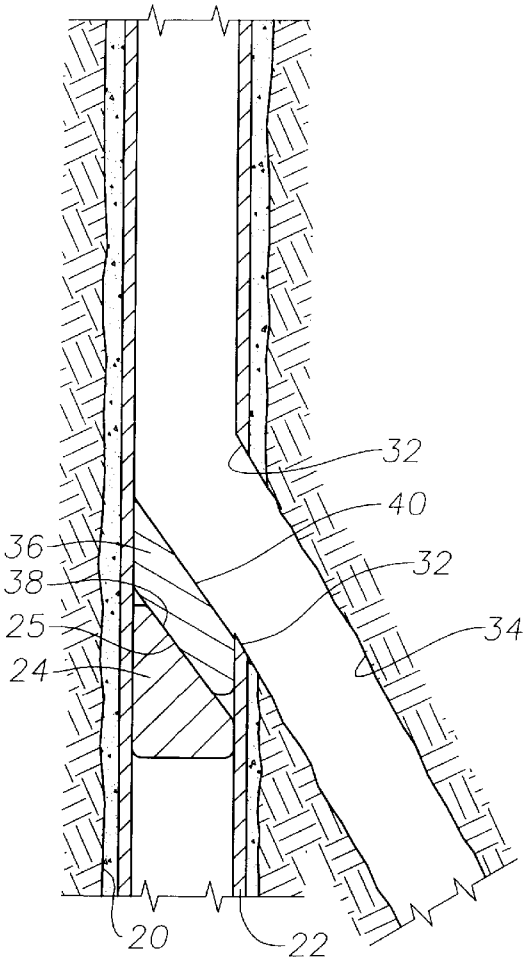
FIG. 4 is an elevation view showing an upper whipstock that has been positioned adjacent the casing window shown in FIGS. 2 and 3—after the window mill pilot shown in FIGS. 2 and 3 has been removed—to guide a section of casing string (not shown in this Figure) into the lateral wellbore shown in FIG. 3.

After the window 32 has been milled in the first casing 22, the next step, as shown in FIG. 3, is to drill a lateral branch wellbore 34. To accomplish this task, a drilling tool (not shown) is lowered into the first casing 22 and is guided along the contoured surface 28 of the window mill pilot 26—or by the lower whipstock 24 if the window mill pilot 26 is not used— through the casing window 32. The drilling tool (not shown) then continues on to drill the lateral wellbore 34. When the lateral wellbore 34 has been drilled, the drilling tool (not shown) is removed, as is the window mill pilot 26. Next, as shown in FIG. 4, an upper whipstock 36 having a lower inclined surface 38 and an upper inclined surface 40 may be optionally run and set in the first casing 22 above and adjacent the lower whipstock 24. The lower inclined surface 38 of the upper whipstock 36 mates with the upper inclined surface 25 of the lower whipstock 24. The upper inclined surface 40 of the upper whipstock 36 should be aligned with the bottom of the casing window 32.

Figure 6:
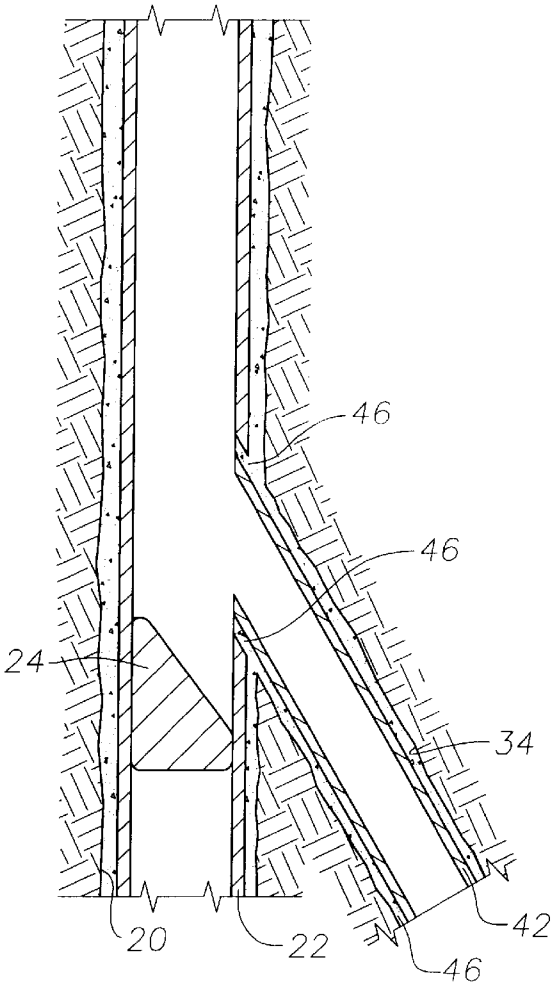
FIG. 6 is an elevation view showing the lateral wellbore casing in place after the stub portion shown in FIG. 5 has been milled off flush with the inner diameter of the central wellbore casing.
Figure 5:
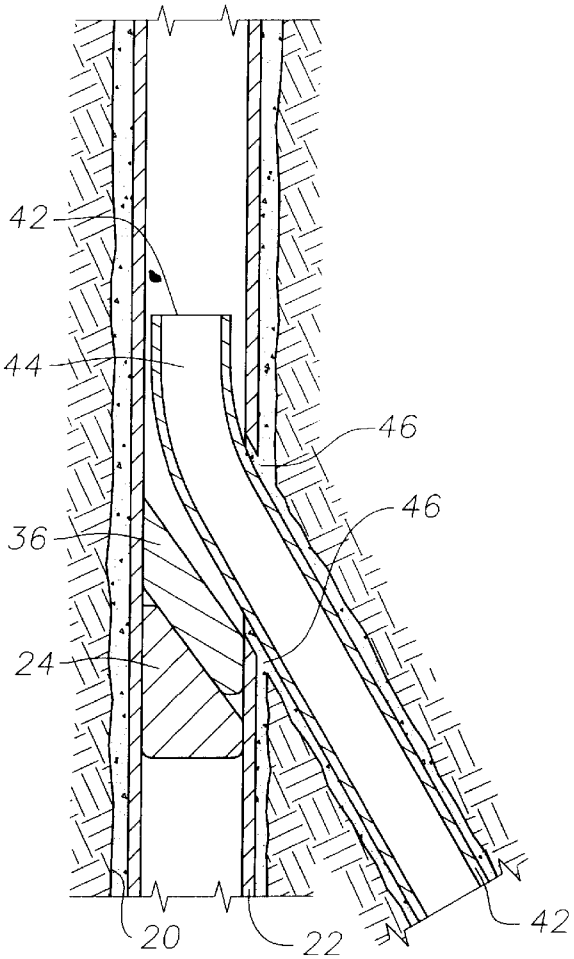
FIG. 5 is an elevation view showing a section of casing string lowered into the lateral wellbore with a stub portion thereof extending into the central wellbore.

After the upper whipstock 36 has been set, the next step, as shown in FIG. 5, is to run a second casing 42 inside the first casing 22 and into the lateral branch wellbore 34, with a stub portion 44 of the second casing 42 extending from the lateral branch wellbore 34 through the casing window 32 into the first casing 22. In an alternative embodiment of the present invention, the step of installing the upper whipstock 36 may be omitted, and the second casing 42 may be guided into the lateral branch wellbore 34 by the window remill pilot 26. After the second casing 42 is positioned in the lateral branch wellbore 34, it is then set in place in a customary manner by use of a setting substance 46, such as cement or other known setting substances. As will be understood by those skilled in the art, the cement 46 may be pumped down the interior of the second casing 42, back up the annulus between the lateral branch wellbore 34 and the second casing 42, and up to, and preferably past, the casing window 32 in the first casing 22. In other words, it is preferred that the cement 46 be pumped out through the space between the casing window 32 and the second casing 42 onto the stub portion 44 of the second casing 42. After the cement 46 has dried, the next step, as shown in FIG. 6, is to mill the stub portion 44 of the second casing 42 flush with the inner diameter of the first casing 22. The upper whipstock 36 is then retrieved and any debris associated with milling the stub portion 44 is cleaned out in a customary manner.

The steps described up to this point represent a common approach currently in use to seal the junction between the first and second casings 22 and 42. This method, however, is believed not to be entirely satisfactory. One major problem with relying on the cement 46 to seal the junction is that, before it sets, it tends to flow downwardly, under the force of gravity, away from the junction. In addition, even when the cement 46 stays in place long enough to dry, due to its porous consistency upon drying, it does not provide an optimum seal. In an effort to provide an improved approach to sealing the junction between a central and a lateral branch wellbore, the present invention was developed. The present invention, as will be described more fully below, may be used in conjunction with the above-described approach, either with or without the cementing step, and with or without certain other steps, as will be more fully explained below.

Figure 7:
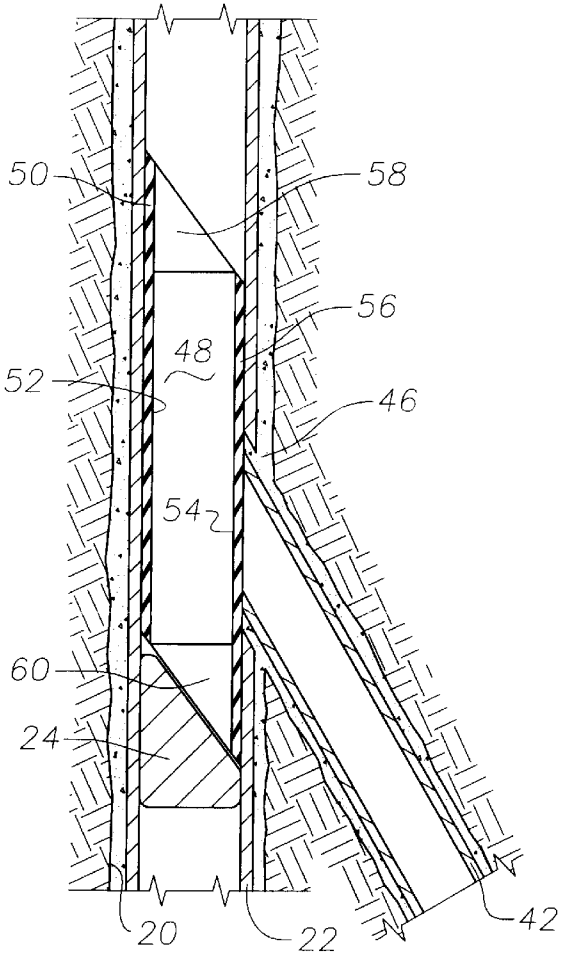
FIG. 7 is an elevation view showing an in-situ polymerizable sealing sleeve positioned adjacent the junction of the central and lateral wellbores.

Referring now to FIG. 7, the next step of the method of the present invention—after the stub portion 44 has been milled flush with the inner diameter of the first casing 22, and after the second casing 42 has been cemented in place, assuming the cementing step is used—is to use a running tool (not shown) to install an in-situ polymerizable sealing sleeve 48 into the first casing 22 adjacent the junction of the first and second casings 22 and 42. The sealing sleeve 48 should be positioned so as to extend across the casing window 32. After positioning the sleeve 48, it should be polymerized and allowed to cure. In a specific embodiment, the sealing sleeve 48 may be of the type described in U.S. Pat. No. 5,494,106, which is incorporated herein by referenced, and in SPE 8202, a paper entitled "In-Situ Polymerisation of an Inflatable Composite Sleeve to Reline Damaged Tubing and Shut-Off Perforation" that was presented at the 1996 Offshore Technology Conference, held in Houston, Tex. Related sleeves are disclosed in PCT applications WO 94-25655 and WO 96-01937. In a specific embodiment, the sleeve 48 may include a cylindrical body 50 having a longitudinal bore 52 therethrough, and may be constructed of fibers and polymerizable resins. The sleeve 48 may also include a drillable sidewall 54 in the cylindrical body 50, and a resilient outer skin 56 substantially covering the cylindrical body 50.

In a specific embodiment, the sleeve 48 may include a first orienting device 58 operably connected at a first end of the sleeve 48, and, if desired, a second orienting device 60 operably connected at an opposite or second end of the sleeve 48. The function of the orienting devices 58 and 60 is to provide a means by which the lateral branch wellbore 34, and more particularly, the second casing 42 disposed therein, may be located when access is desired thereto, and a means for selectively directing a well tool (not shown) into the second casing 42. The structure and operation of the orienting devices 58 and 60 will be readily apparent to those of ordinary skill in the art. For example, the orienting devices 58 and 60 may be of the type disclosed in U.S. Pat. No. 3,889,748 (see FIG. 1, and the helical guide surface 63) and U.S. Pat. No. 4,106,563 (see FIG. 1A, and the guide surface 34), both of which are commonly assigned hereto and incorporated herein by reference. The scope of the present invention is not to be limited to any particular orienting device.

Figure 8:
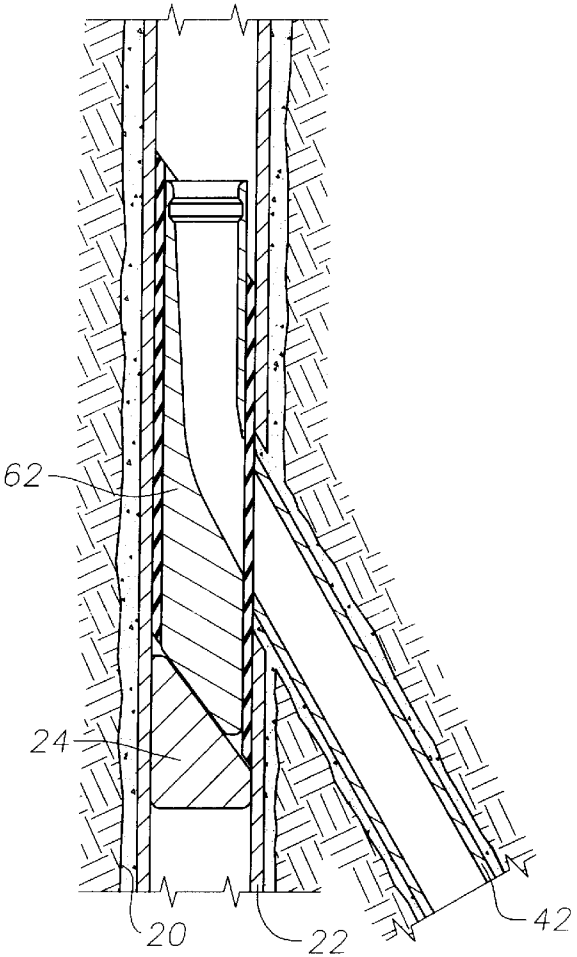
FIG. 8 is an elevation view showing a remilling tool located inside the in-situ polymerizable sleeve and adjacent the casing window.

After the sleeve 48 has been installed and allowed to cure, the next step is to cut a window through the drillable sidewall 54 in the sleeve 48 adjacent the casing window 32 to provide access to the second casing 42. Referring now to FIG. 8, this task is accomplished by using a running tool (not shown) to run a window remill pilot 62—similar to, but diametrically smaller than, the window mill pilot 26 shown in FIGS. 2 and 3—inside the sleeve 48. The window remill pilot 62 is set in place such that it is oriented and aligned with the second casing 42, which is now covered by the sleeve 48. The window remill pilot 62 may be oriented off the lower whipstock 24 or by one of the orienting devices 58 or 60, which, as discussed above, may be connected to opposed ends of the sleeve 48.

Figure 9:
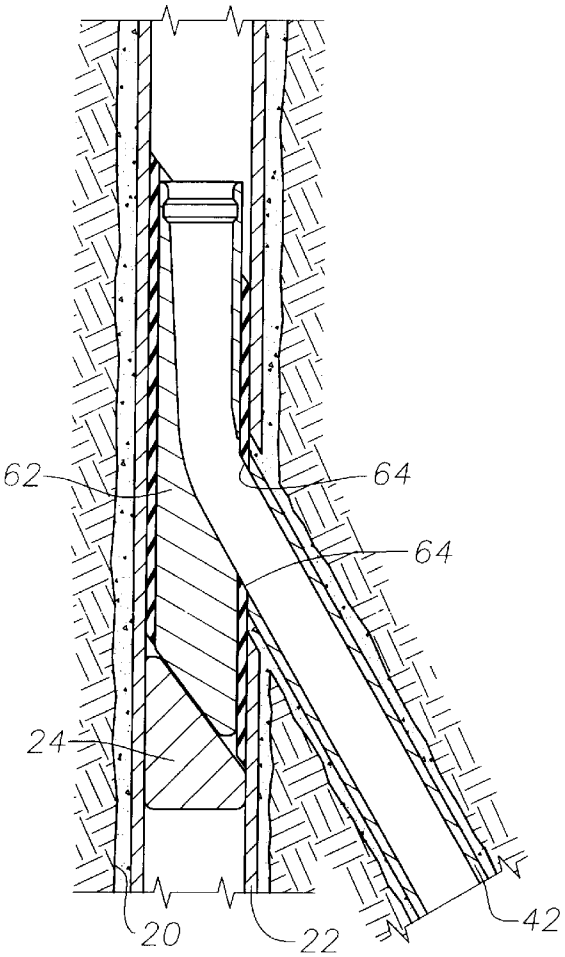
FIG. 9 is an elevation view showing a window that has been cut into the in-situ polymerizable sleeve adjacent the casing window, with the remilling tool shown in FIG. 8 still in place inside the in-situ polymerizable sleeve.
Figure 10:
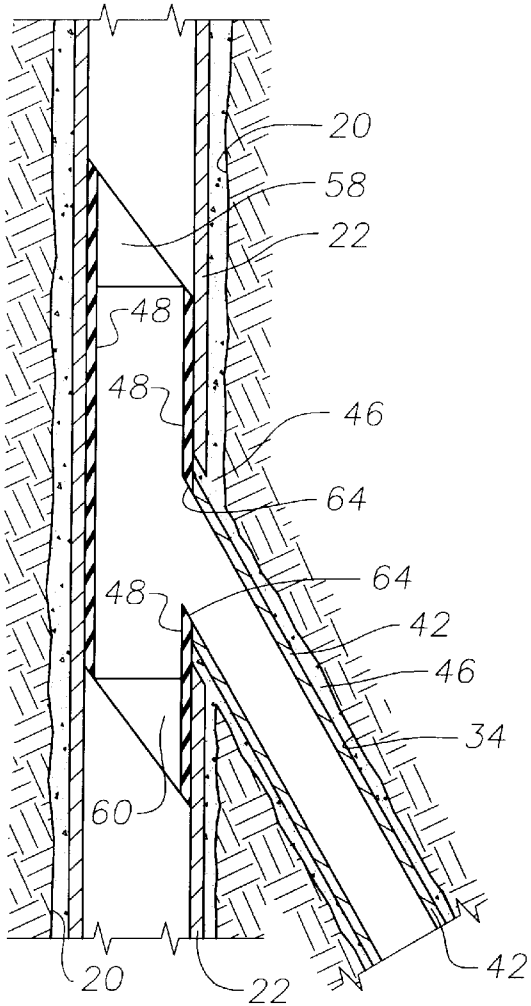
FIG. 10 is an elevation view similar to FIG. 9 except that the remilling tool and lower whipstock have been removed in this Figure.

After the window remill pilot 62 has been set in place, and after removing the running tool (not shown) used to run the window mill pilot 62 into the sleeve 48, the next step, as illustrated in FIG. 9, is to run a milling tool, such as a tapered mill (not shown), into the window remill pilot 62, which will guide the milling tool so that it will mill a sleeve window 64 through the sleeve 48. In a specific embodiment, the sleeve window 64 may be milled flush with the inner diameter of the second casing 42. Referring now to FIG. 10, the next step is to retrieve the window remill pilot 62, and then remove the lower whipstock 24, either by retrieving it upwardly through the sleeve 48 or by simply drilling it out, in a manner known to those of skill in the art. When the operation is complete, the sleeve 48 will be installed in place and will be provided with the sleeve window 64, as shown in FIG. 10, through which access may be had to the second casing 42. Thus, in accordance with an important object of the present invention, the junction between the first and second casings 22 and 42 will be sealed by the sealing sleeve 48, either as a primary seal, if the cementing step is omitted, or as a back-up seal to the cement 46, if the cementing step is carried out, as explained above. It is believed that the sealing method and apparatus of the present invention overcomes the above-discussed deficiencies associated with prior approaches to sealing the junction of a central and lateral wellbore. Further, in accordance with another important object of the present invention, if the sealing sleeve 48 of the present invention is provided with at least one orienting device 58 or 60, the second casing 42 may be located when access is desired thereto, and a means for selectively directing a well tool (not shown) into the second casing 42 disposed in the lateral branch wellbore 34 is available. Moreover, the above objects are achieved by the present invention without introducing significant restrictions in the central or lateral wellbores.

It is to be understood that the invention is not limited to the exact details of construction, operation, exact materials or embodiments shown and described, as obvious modifications and equivalents will be apparent to one skilled in the art. For example, the step of running and setting the window mill pilot 26 may be eliminated, and the lower whipstock 24 may be used to divert the milling tool (not shown) and the drilling tool (also not shown) to their desired locations. It should also be understood by those of skill in the art that the use of the method and apparatus of the present invention to reenter a central wellbore having one or more lateral branch wellbores that have been sealed with cement, or other known sealing substance, to provide a backup seal to the cement, or other sealing substance, is intended to be within the spirit and scope of the present invention. Accordingly, the invention is therefore to be limited only by the scope of the appended claims.

I claim:

1. A method of sealing a junction between a central wellbore having a first casing and at least one lateral branch wellbore comprising the steps of:

running and setting a lower whipstock in the first casing;

running and setting a window mill pilot in the first casing;

milling a window in the first casing;

drilling a lateral branch wellbore through the casing window out from the central wellbore;

removing the window mill pilot from the first casing;

running and setting an upper whipstock in the first casing adjacent and above the lower whipstock;

running a second casing into the first casing, through the casing window, and into the lateral branch wellbore such that a stub portion of the second casing extends from the lateral branch wellbore through the casing window and into the first casing;

milling the stub portion of the second casing flush with an inner diameter of the first casing;

retrieving the upper whipstock from the first casing;

running and installing an in-situ polymerizable sleeve in the first casing adjacent the junction of the first and second casings;

running and setting a window remill pilot inside the in-situ polymerizable sleeve adjacent the junction of the first and second casings;

milling a window in the in-situ polymerizable sleeve;

retrieving the window remill pilot from inside the in-situ polymerizable sleeve; and removing the lower whipstock from the first casing.

2. The method of claim 1, wherein an upper surface of the upper whipstock is aligned with a lower edge of the casing window when the upper whipstock is set in place.

3. The method of claim 1, furthering including the step of cleaning the first casing after the step of milling the stub portion flush with the inner diameter of the first casing.

4. The method of claim 1, wherein the window in the in-situ polymerizable sleeve is milled flush with an inner diameter of the second casing.

5. The method of claim 1, wherein the lower whipstock is removed by retrieving it through the in-situ polymerizable sleeve.

6. The method of claim 1, wherein the lower whipstock is removed by drilling it out.

7. The method of claim 1, further including the step of using a sealing substance to set the second casing in place within the lateral branch wellbore after it has been positioned and before its stub portion is milled flush with the inner diameter of the first casing, whereby the polymerizable sleeve operates as a back-up seal to the sealing substance.

8. The method of claim 7, wherein the sealing substance is cement.

9. The method of claim 1, wherein the sleeve further includes at least one orienting device for locating the second casing when access is desired thereto, and for selectively directing a well tool into the second casing.

10. The method of claim 1, wherein the sleeve further includes a first and a second orienting device, the first orienting device being attached to a first end of the sleeve, and the second orienting device being attached to a second end of the sleeve, the orienting devices being used to locate the second casing when access is desired thereto, and to selectively direct a well tool into the second casing.

11. The method of claim 1, wherein the sleeve further includes:

a cylindrical body having a longitudinal bore therethrough constructed of fibers and polymerizable resins;

a drillable sidewall in the cylindrical body; and a resilient outer skin substantially covering the cylindrical body.

12. A method of sealing a junction between a central wellbore having a first casing and at least one lateral branch wellbore comprising the steps of:

running and setting a whipstock in the first casing;

diverting a milling tool off the whipstock to mill a window in the first casing;

drilling a lateral branch wellbore through the casing window out from the central wellbore;

running a second casing into the first casing, and diverting the second casing off the whipstock through the casing window and into the lateral branch wellbore such that a stub portion of the second casing extends from the lateral branch wellbore through the casing window and into the first casing;

milling the stub portion of the second casing flush with an inner diameter of the first casing;

running and installing an in-situ polymerizable sleeve in the first casing adjacent the junction of the first and second casings;

milling a window in the in-situ polymerizable sleeve adjacent the casing window; and, removing the whipstock from the first casing.

13. The method of claim 12, furthering including the step of cleaning the first casing after the step of milling the stub portion flush with the inner diameter of the first casing.

14. The method of claim 12, wherein the window in the in-situ polymerizable sleeve is milled flush with an inner diameter of the second casing.

15. The method of claim 12, wherein the whipstock is removed by retrieving it through the in-situ polymerizable sleeve.

16. The method of claim 12, wherein the whipstock is removed by drilling it out.

17. The method of claim 12, further including the step of using a sealing substance to set the second casing in place within the lateral branch wellbore after it has been positioned and before its stub portion is milled flush with the inner diameter of the first casing, whereby the polymerizable sleeve operates as a back-up seal to the sealing substance.

18. The method of claim 17, wherein the sealing substance is cement.

19. The method of claim 12, wherein the sleeve further includes at least one orienting device for locating the second casing when access is desired thereto, and for selectively directing a well tool into the second casing.

20. The method of claim 12, wherein the sleeve further includes a first and a second orienting device, the first orienting device being attached to a first end of the sleeve, the second orienting device being attached to a second end of the sleeve, and the orienting devices being used to locate the second casing when access is desired thereto and to selectively direct a well tool into the second casing.

21. The method of claim 12, wherein the sleeve further includes:

a cylindrical body having a longitudinal bore therethrough constructed of fibers and polymerizable resins;

a drillable sidewall in the cylindrical body; and a resilient outer skin substantially covering the cylindrical body.

22. In a central wellbore having at least one lateral branch wellbore extending therefrom, the central wellbore having a first casing disposed therein, the first casing having a casing window disposed therein, the lateral branch wellbore having a second casing disposed therein and adjacent the casing window to form a junction between the first and second casings, an improved method of sealing the junction, wherein the improvement comprises the steps of:

installing an in-situ polymerizable sleeve in the first casing adjacent the junction so as to cover the casing window and seal the junction, the sleeve including at least one orienting device for locating the second casing when access is desired thereto, and for selectively directing a well tool into the second casing; and, milling a window in the in-situ polymerizable sleeve.

23. The method of claim 22, further including the steps of:

running and setting a window remill pilot inside the in-situ polymerizable sleeve adjacent the junction after the sleeve is installed and before the sleeve window is milled; and retrieving the window remill pilot from inside the in-situ polymerizable sleeve after the sleeve window is milled.

24. The method of claim 22, wherein the window in the in-situ polymerizable sleeve is milled flush with an inner diameter of the second casing.

25. The method of claim 22, wherein the sleeve further includes a first and a second orienting device, the first orienting device being attached to a first end of the sleeve, and the second orienting device being attached to a second end of the sleeve, the orienting devices being used to locate the second casing when access is desired thereto, and to selectively direct a well tool into the second casing.

26. The method of claim 22, wherein the junction has been previously sealed by a sealing substance and the in-situ polymerizable sleeve functions as a backup seal to the previous seal.

* * * * *